United States Patent [19]

Knorreck

[11] 4,148,290

[45] Apr. 10, 1979

[54] CENTRIFUGAL REGULATOR SYSTEM FOR FUEL INJECTION COMBUSTION ENGINES

[75] Inventor: Peter Knorreck, Weissach, Fed. Rep. of Germany

[73] Assignee: Robert Bosch GmbH, Stuttgart, Fed. Rep. of Germany

[21] Appl. No.: 812,199

[22] Filed: Jul. 1, 1977

[30] Foreign Application Priority Data

Jul. 1, 1976 [DE] Fed. Rep. of Germany ..... 2629620

[51] Int. Cl.[2] ..... F02D 1/04

[52] U.S. Cl. ..... 123/140 R

[58] Field of Search ..... 123/140 R

[56] References Cited

U.S. PATENT DOCUMENTS

| | | | |
|---|---|---|---|
| 3,577,968 | 5/1971 | Staudt et al. | 123/140 R |
| 3,672,343 | 6/1972 | Biechl et al. | 123/140 R X |
| 3,884,206 | 5/1975 | Ritter | 123/140 R |
| 4,038,958 | 8/1977 | Susuki | 123/140 R |

*Primary Examiner*—Charles J. Myhre

*Assistant Examiner*—Tony M. Argenbright

*Attorney, Agent, or Firm*—Edwin E. Greigg

[57] ABSTRACT

A centrifugal regulator for an internal combustion engine having a fuel injector controllable by actuation of a control rod. Movement of the governor sleeve upon a variation in rpm is transferred to a spring-biased support lever, which is pivotally connected to a guide lever by a fixed pivot thereof, which guide lever is pivotally connected to an intermediate lever by a fixed pivot thereof, which lever is provided with a pivot axis and a link connecting it with the control rod. Various types of relationship between fuel injection rate and rpm are obtained by means of several differently placed adjustable or resilient stops provided on the spring-urged support lever and in the regulator housing. These stops come into play in a multi-stage serial relationship, allowing the support lever and the intermediate lever to severally pivot and rotate, thus transferring governor sleeve movement to the intermediate lever and the control rod.

9 Claims, 2 Drawing Figures

CENTRIFUGAL REGULATOR SYSTEM FOR FUEL INJECTION COMBUSTION ENGINES

BACKGROUND OF THE INVENTION

Centrifugal rpm regulators for injected combustion engines are known that have a governor sleeve that is rpm-dependently displaceable via centrifugal weights and can transmit its control motion via at least one intermediate lever to the fuel quantity adjustment member that controls fuel supply from the fuel pump, thereby acting on a force transfer member, supported at the regulator housing and at the same time acting indirectly upon the fuel quantity adjustment member. These elements are subjected to the force of at least one control spring and include at least one elastically sprung contact engaging the force transfer member and thereby effectively come into engagement with the governor sleeve, as well as encompassing a swing lever that transmits the spring-urged travel of the contact, respectively of the adjustment control path of the governor sleeve, whose swing axle is provided with a clearance. That facilitates control movements in opposition to the prevailing control motion during at least a portion of the spring-urged travel of the contact.

There is also known a centrifugal regulator (German OS No. 1 954 834) whose adjustment control mechanism is equipped with a swing lever which facilitates control rod movement variable with rpm level that is, the control rod (and thus the maximum fuel supply) can be varied either to provide a lesser or greater quantiy of fuel during a rise in the rpm level. This latter device has several disadvantages which stem from its construction, in particular the jointed connection of the swing lever to the intermediate lever, the butting of the swing lever against at least two detents remotely situated from each other and located on the force transfer member, and at least one of the detents is elastically deflected, all of which factors account for increased friction due to the demands of pressure and sliding forces upon the pivot and the detents occurring under the force of displacement of the governor sleeve during the swinging motion of the swing lever, thus adversely affecting control rod adjustment and detrimentally influencing the fuel adjustment control of the regulator. In addition, the higher torsional stresses conducted to the swing lever during control rod adjustment are to be considered a further disadvantage of the mechanism embodied in that known regulator, since they can lead to an undesirable control rod position adjustment.

OBJECTS AND SUMMARY OF THE INVENTION

It is the primary object of this invention to pivotally affix a swing lever to the force transfer member in such a manner that the governor member has an extremity that abuts the swing lever and the force transfer member provides a counter-acting force.

It is a further object of this invention to provide the governor sleeve with a pivot point through which it will by means of a guide lever be oscillatably attached to a free end of the force transfer member.

It is still a further object of this invention to provide the force transfer member with a spring capsule which contains plural springs, one of which acts in opposition to the governor member and the other acts in parallel therewith.

It is still another object of the invention to provide a centrifugal regulator system in which frictional forces cannot adversely affect the fuel supply adjustment processes.

It is yet a further object of the invention to alleviate the aforementioned disadvantages which are associated with known centrifugal regulators.

SUMMARY OF ADVANTAGES AND IMPROVEMENTS

The centrifugal regulator of the invention, on the one hand, possesses the advantage that the friction occurring during the adjustment of control rod position cannot influence the fuel supply process detrimentally due to the arrangement of the swing lever in parallel with, and outside of, the force flow between the governor sleeve and the fuel quantity adjustment member. Only slight forces, created by the restoring means, appear at the force juncture between the intermediate lever and the swing lever, so that from there only very slight frictional forces are conducted through the regulator.

Further advantageous improvements of the centrifugal rpm regulator are provided, namely, by an improved utilization of the governor sleeve travel via a contact component preferably contained within the regulator housing and by the favorable force transfer of the intermediate lever thereby made possible. Fine control rod direction adjustment including direction reversal in opposition to the prevailing control motion is also advantageously and precisely executable, and each point of the control rod adjustment change, to increase, hold constant, or decrease fuel supply, can be set without impairment of the other set points.

The adjustment of the regulator is substantially simplified and can be undertaken exteriorly without the external placement of its important component parts because of the elastically yielding spring contact mounted in the preset spring retainer. It is particularly advantageous that the spring retainer is inserted into the force transfer member at a point thereon axial with the governor sleeve. Virtually all rotational and torsional movements caused by the regulator control forces are advantageously isolated from the swing lever. Only a relatively few, simple components are required to control the injector rod adjustment process which facilitates the manufacture of a small, inexpensive regulator possessing high control capabilities.

The invention will be better understood as well as further objects and advantages thereof become more apparent from the ensuing detailed description of a preferred embodiment taken in conjunction with the drawing.

DESCRIPTION OF THE INVENTION

Figure 1:
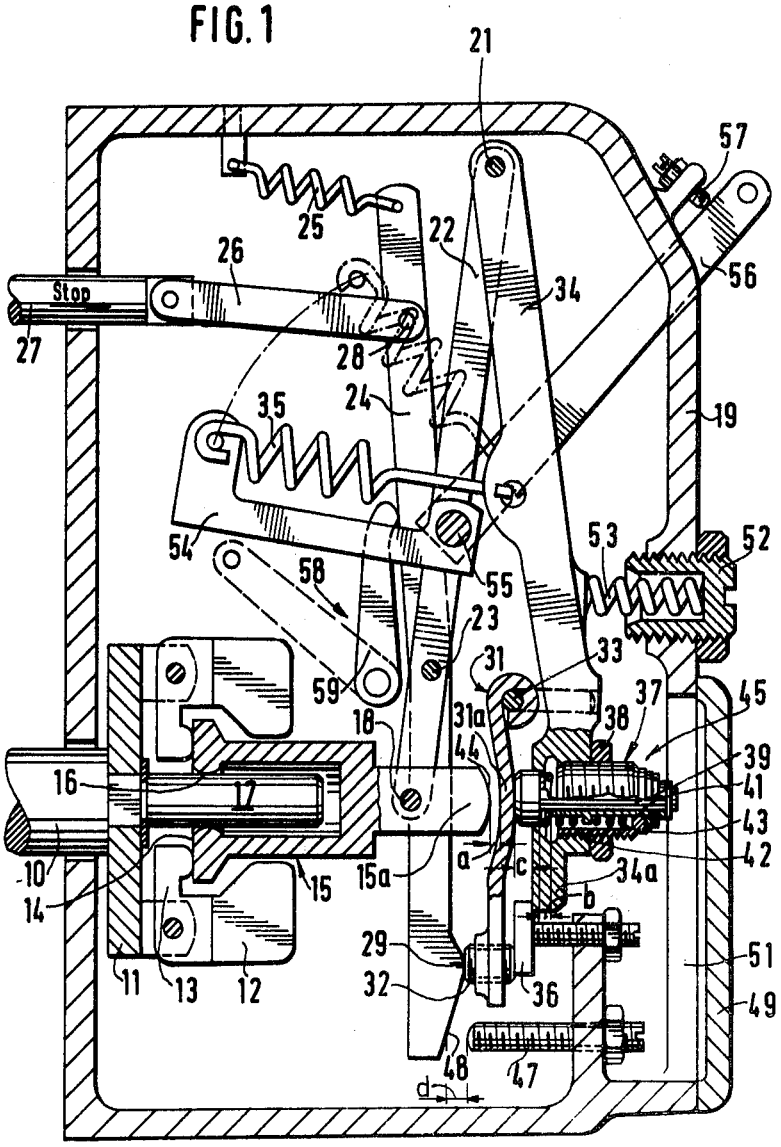
FIG. 1 is a schematic representation, partly in cross section of the centrifugal rpm regulator following the invention.

There is shown in FIG. 1 a carrier member 11, pivotally supporting the centrifugal weights 12, attached to the camshaft 10, which serves as the regulator drive shaft of a fuel injection pump, not shown, for an internal combustion engine. The arms 13 on the centrifugal weights 12 engage the contact surface 14 of a governor sleeve 15 which serves as the regulator actuator. The governor sleeve 15 is slidable at its one extremity adjacent to the contact surface 14 on a guide member 17, connected to the camshaft 10, by means of a collar 16. The guide member 17 is constructed as a cylindrical shank of the camshaft 10; alternatively it can also be a part of the drive carrier 11. The opposite extremity of the governor sleeve, designated 15*a*, is pivotally connected by means of a pivot bolt 18, with a guide lever 22 pivotally supported on a support bolt 21 within the regulator housing 19. The thereby formed two-point support of the governor sleeve 15 decreases the friction of the sleeve considerably.

A bolt 23 which serves as the pivot point for an intermediate lever 24, is attached to the guide lever 22 between the pivot bolt 18 and the support bolt 21. A starting spring 25 is attached at one end to the regulator housing 19 and at the other end to the intermediate lever 24 and serves simultaneously as the restoring means and as the starting spring. The starting spring 25 tends to displace a control rod 27 of the fuel injection pump, serving as the fuel control adjustment member connected to the intermediate lever 24 via link 26 in the axial direction of increased fuel supply. The link 26 and the control rod 27 are connected at a pivot point 28 toward the extremity of the intermediate lever 24 provided with the starting spring 25. The intermediate lever 24 acts upon a swing lever 31 through a contact point 29 in its extremity remote from the pivot points 23 and 28. The starting spring 25 maintains the contact point 29 of the intermediate lever 24 in the position shown in FIG. 1 in contact with a set screw 32, provided on the swing lever 31, which screw serves as the counter support for the contact point 29. This set screw 32 allows adjustment of the mutually relative positions of the intermediate lever 24 and the swing lever 31.

The swing lever 31 comprises a one-armed lever carrying the set screw 32 at its free end, and is provided with an axle 33 fixedly attached to a force transfer member 34. The force transfer member 34, comprising a one-armed support lever, is pivotally mounted on the support bolt 21 of the regulator housing 19 together with the guide lever 22 and is urged at its lower extremity 34*a* by a swivelable regulator spring 35 forming a tension spring against an adjustable stop screw 36 incorporated in the housing 19.

A spring retainer 37 secured by a nut 38 in an installed position serves as a yielding contact point and is screwed into the force transfer member 34 co-axially with the governor sleeve 15. The spring retainer 37 includes a contact bolt 39, a contact shell 41, and two springs 42 and 43 mounted in tandem, in addition to safety and support washers not delineated further.

Between the axle 33 and the set screw 32 which serves as the counter support for the contact point 29 of the intermediate lever 24 lies a region designated 31*a* at the level of the axis of the regulator sleeve 15. The region 31*a* of the swing lever 31 presses continuously with its one side against the contact bolt 39 of the spring retainer 37 under the force transmitted via the intermediate lever 24 from the starting spring 25, or under the force of the governor sleeve 15. On its other side, the swing lever 31 is subjected to the action of the convexed surface 44 of the governor sleeve 15, which surface 44 presses continuously against the swing lever 31, after traversing a sleeve excursion "a" which occurs at rpm levels above that of the starting rpm.

The spring retainer 37 and the swing lever 31 comprise the primary component parts of an adjustment mechanism 45 capable, as is further explained below, of effecting movement of the control rod 27 to increase fuel supply during an increase of the rpm, in spite of the concurrent movement of the governor sleeve 15 to decrease fuel supply. This contrary, opposed directional movement of the control rod 27, in opposition to the sense of the prevailing control motion is also called "negative approximation", whereby the control rod 27 of the injection pump is displaced during increased rpm's so as to direct the apportionment of an increased fuel supply. This movement in opposition to the prevailing control motion is essentially accomplished by means of the lever arm force translation of the swing lever 31, whose set screw 32, which serves as the counter support for the contact point 29 of the intermediate lever 24, executes a greater stroke during axial movement of the governor sleeve 15 than does the sleeve, so that the contact point 29 executes a longer travel than the bolt 23, which serves as the pivot point for the intermediate lever 24, and thus the intermediate lever 24 rotates about bolt 23 in a counterclockwise direction.

To terminate or to reverse the control movement of the intermediate lever 24 moving in opposition to the prevailing control motion effected by the swing lever 31, a stop 47 is provided in the form of a set screw secured in the regulator housing 19. This set screw 47 is placed in such a manner that a contact surface 48 at the lower extremity of the intermediate lever 24 having the contact point 29 just touches the set screw 47 after the contact bolt 39 has traversed a pre-set distance designated "b", whereupon its travel is limited by the shell 41 of the spring retainer 37. Thus, upon further axial movement of the governor sleeve 15 the set screw 47 acts as the momentary pivot point for the intermediate lever 24.

If the protruding dimension designated "c" of the contact bolt 39 is, as shown, greater than "b", then not only can there be movement of the control rod in opposition to the prevailing axial motion of the governor sleeve, but there can also be control rod movement toward "stop"; the former being opposed directional movement, the latter being uni-directional movement. The associated adjustment control path is then "c"−"b" and the corresponding rpm range is determined by the pre-loaded tension and the stiffness of the adjustment spring 43. When "b" and "c" are equal, then only one adjustment point is provided for motion opposing prevailing control motion and only one adjustment spring is needed (not shown). The dimension "b", determining the adjustment control path allowing opposed directional movement and the pre-loaded tension and stiffness (spring rates) of the adjustment springs 42 and 43, determining the characteristics of the adjustment process, can advantageously be pre-set at the spring retainer 37, prior to its installation into the regulator, so that only the protruding dimension "c" must be set at the regulator. The spring retainer 37 can also be adjusted, together with the support lever 34, prior to their installation, so that the protruding dimension "c" is then also preset. The positioning of the spring retainer 37, the contact screw 36, and the set screw 47 can readily be carried out externally of the regulator through an opening 51 in the regulator housing 19 upon removal of a cover 49. An auxiliary idle spring 53, retained in a screw shell 52 and acting on the support lever 34, can also be adjusted from the same side of the regulator housing.

The regulator spring 35, made pivotal to vary its force, direction and pre-tension, is hooked with one end to the support lever 34 and with its other end into a lever 54 and connected via a shaft 55 to an operating lever 56 positioned externally of the regulator housing 19. The motion of the lever 56 is delimited by a stop 57 and the pre-set stop position determines the maximum engine rpm allowed by the regulator. If the regulator spring 35 is brought to the location represented by the dash-dotted lines by rotating the levers 56 and 54 in a clockwise direction, then a correspondingly lower partial-load rpm or idle rpm is the maximum rpm attainable.

It is especially important, particularly in an emergency, that the control rod 27 can be moved in the direction of stop without excessive effort or the destruction of vital components despite the fact that the lever 56 is in the full load position, or that the other regulator components are in any other attitude not corresponding to the stopped position. Such an emergency shutdown is accomplished in the centrifugal rpm regulator of the invention by a particularly simple means, due to the force coupling between the intermediate lever 24 and the swing lever 31 created by the start spring 25 with the aid of a shutdown device which acts at least indirectly on the intermediate lever so to turn the lever 24 clockwise, thus lifting its contact point 29 off the counter support 32. Such a shutdown device of simple construction is designated 58 in FIG. 1 and contains a shutdown lever 59 which acts directly upon the intermediate lever 24. A similar shutdown device could also act directly on the control rod 27, or on that extremity of the intermediate lever 24 provided with the support point 29.

Figure 2:
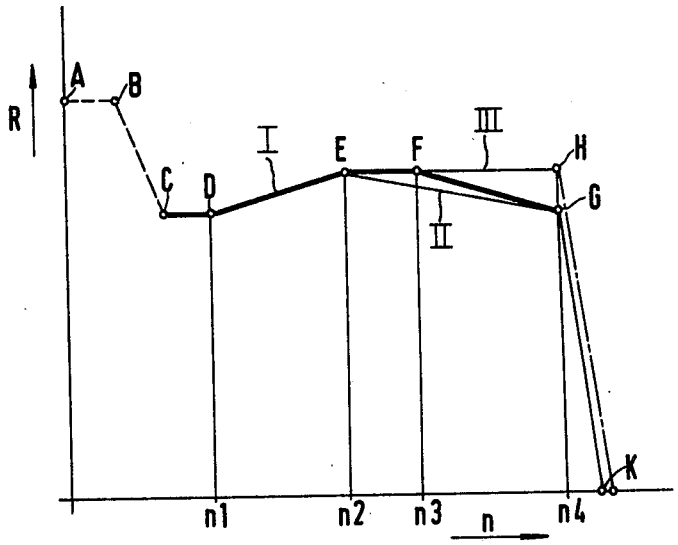
FIG. 2 is a diagram illustrating the fuel supply adjustment control curves made possible by the invention.

The fuel supply adjustment processes achieved by the centrifugal rpm regulator of the invention are diagrammatically plotted as a fuel supply control rod graph in FIG. 2. The abscissa represents the rpm "n", and the ordinate represents the position of the control rod R. The dashed line ABC shows the control rod travel in the lower rpm range, from a high fuel supply position for starting, where the control rod is under the influence of the start spring 25, line A-B, to a lower fuel supply level corresponding to the control rod travel to point C. The heavy line DEFG between the rpm lever n1 to n4 is designated I; this line shows the control rod adjustment path wherein the centrifugal rpm regulator according to the invention first effects a negative adjustment of control rod direction from points D to E, and then effects a contrary direction adjustment from points F to G. Between points E and F no directional adjustment of control rod movement is taking place. Alternatively, if control is desired over points E–F, then the control rod travel adjustment process can also be effected over path DEG corresponding to the line designated II. If only negative adjustment over points D to E is desired, then the rod adjustment path proceeds through points DEFH according to the line designated III. The points E and F correspond to the rpm points n2 and n3.

DESCRIPTION OF OPERATION

FIG. 1 shows all of the regulator components in rest position: the operating lever 56 butts against the stop 57, the control spring 35 is pre-loaded to effect the maximum rpm (magnitude n4 of FIG. 2), the force transfer lever 34 is pulled at its lower end **34*a* aganist the stop screw 36, and the control rod 27 is displaced to its starting position (designated A in FIG. 2) by means of the starting spring 25 so that the injection pump supplies the additional fuel required for starting the engine. After starting the engine, the higher fuel supply lever provided at point A remains constant up to an rpm level corresponding to point B which level is determined by the pre-tension of the starting spring 25, at which rpm level the governor sleeve 15 moves through its starting travel "a" until the surface 44 abuts the swing lever 31, which movement causes the guide lever 22 to be turned counterclockwise by pivot bolt 18 and this movement is conveyed to the bolt 23, serving as the pivot for the intermediate lever 24 which also moves to the right. The intermediate lever 24 whose contact point 29 abuts the set screw 32 of the swing lever 31, is thus rotated clockwise, so that control rod 27 is moved from the starting position to a lower fuel supply position (designated C in FIG. 2) via a rightward shift of the link 26**.

Due to pre-loading on the adjustment spring 42, the control rod 27 remains in that fuel supply location designated C up to rpm level n1, corresponding to point D. Upon a rpm rise above level n1, the adjustment spring 42 recedes, allowing the contact bolt 39 to move to the right through adjustment control travel "b" until bounded by the shell 41. As the contact bolt 39 recedes into the shell 41, the swing lever 31 swings about its axle 33, and the set screw 32, serving as the counter support for the intermediate lever 24, moves through an arc proportional to the length of the lever, and thus, in accordance with the lever ratio. Throughout all these movements of other components, the intermediate lever 24 remains in continuous contact at its contact point 29 with the set screw 32 via the starting spring 25 and as hereinabove described, because the contact point 29 moves through a longer travel than the bolt 23, the intermediate lever 24 rotates counterclockwise so that the control rod 27 is displaced (from point D to point E of FIG. 2). This action effects a negative adjustment of control rod 27, and thus a correspondingly increased fuel supply during a rise of the rpm from n1 to n2.

Upon a further rise of the rpm from n2 to n3, no control rod movement takes place, because of the preloading on the second adjustment spring 43. As the rpm's rise above n3, the second adjustment spring 43 also recedes, and the intermediate lever 24 having before moved through the adjustment control travel "d" (corresponding to "b") with its contact surface 48 abutting set screw 47, is now rotated to effect further control rod movement, that is clockwise about the bolt 23, so that the control rod 27 is moved to the point designated G until rpm level n4 is reached. The positive adjustment travel of the control rod thus effected which causes a fuel supply reduction to take place with a rise in the rpm level, ends exactly at the governor shutdown rpm level n4. This shutdown point can also occur at a rpm level below that of n4 by an appropriate pre-loading tension of the adjustment spring 43, and the judicious adjustment of the protrusion dimension "c". In the regulator, according to the invention, the given rpm ranges and the control adjustment travel can be varied independently of one another within relatively wide limits, and thus can be tailored to the required characteristics graph of a given engine by appropriate choice of the pre-loading and spring stiffness of the adjustment springs 42 and 43 and by appropriate choice of the correspondingly set dimensions "b" and "c".

If only negative adjustment of the control rod is desired, then the dimension "c" is reduced to the same value as "b" and the set screw 47 is adjusted so that the contact surface 48 of the intermediate lever 24 just touches the set screw 47 after the lever has travelled through control path "c". If the fuel supply is desired to proceed through rpm levels n1 to n4, i.e. from D to G without a plateau between the points E and F, as shown by the line II, then the pre-loading on the second adjustment spring 43 must be set so that the spring begins to recede as soon as the lower end 34*a* of lever 34 has travelled through control path "b". Such control path can also be effected by use of a single spring in the spring retainer 37, with a correspondingly adjusted set screw 47; point E is then determined solely by the position of the set screw 47. However, the slope of the curve portion E–G is dependent upon the slope of the curve portion D–E, due to the fixed spring stiffness and hence the former cannot be varied at will.

When the regulator rpm's exceed the preset governor point n4, then the surface 44 of the control sleeve 15 presses upon the support lever 34, via the swing lever 31 abutted firmly against it, pushing support lever 34 away from the contact point 36, thus overcoming the preloaded spring force of the control spring 35 and rotating support lever 34 in a counterclockwise direction about its axis, bolt 21. Thereupon, the bolt 23 is moved to the right by the guide lever 22, and the intermediate lever 24, with its contact point 48 abutting against the set screw 47, thus executes a clockwise turning movement, pulling the control rod 27 toward the stopped position, which action is represented in FIG. 2 by the curve portion G–K.

The subject of the invention is not restricted in any way to the embodiment shown in FIG. 1, rather the component parts are changeable within the spirit of the invention. Thus, the guide lever 22 can be omitted, and the function of the bolt 23 assumed by the pivot bolt 18, with control sleeve 15 guided by other corresponding means. Alternatively, the set screw 47 can be attached to the support lever 34, if, as thus altered, the force translation then provided is sufficient for the correct functioning of the regulator. Instead of the pivotable control spring 35, a pressure spring could be provided to act on the support lever 34, and the support lever 34, serving as the force transfer member, alternatively can be constructed as a two-armed lever, or be supplanted by an appropriate receding support member with guide means in the regulator housing.

What is claimed is:

1. A centrifugal regulator system for fuel injection combustion engines having a fuel pump, comprising a fuel quantity adjustment member for adjusting the fuel quantity transported by said fuel pump, a governor member that is rpm-dependently displaceable by means of centrifugal weights, at least one intermediate lever for transmitting the governing motion of said governor member to said fuel quantity adjustment member, a force transfer member indirectly acting upon said fuel quantity adjustment member, at least one spring element for applying a force to said force transfer member, at least one elastically sprung contact element engaging said force transfer member and said governor member, and a swing lever interposed between said governor member and said force transfer member, further characterized in that said swing lever has a fulcrum which is swingably connected with said force transfer member, said intermediate lever further being arranged to abut said swing lever at a point remote from said governor member and said fuel quantity adjustment member, and a further spring means tending to maintain said swing lever in contact with said intermediate lever.

2. A centrifugal regulator system according to claim 1, wherein said intermediate lever has a lower extremity and including an adjustable means arranged to engage said intermediate lever lower extremity to vary the pivotal movement of said intermediate lever.

3. A centrifugal regulator system according to claim 1, in which said further spring means tilts said intermediate lever to displace the same and said fuel quantity adjustment member in a direction toward the apportionment of a greater injection quantity.

4. A centrifugal regulator system according to claim 3, in which said elastically sprung contact element further includes a spring retainer adjustably affixed to said force transfer member in axial alignment with said governor member, said swing lever being arranged to depend between said spring retainer and said governor member.

5. A centrifugal regulator system according to claim 1, in which said elastically sprung contact element further includes a spring retainer adjustably affixed to said force transfer member in axial alignment with said governor member, said swing lever being arranged to depend between said spring retainer and said governor member.

6. A centrifugal regulator system according to claim 5, in which said spring retainer includes two spring means, one of which acts in opposition to said governor member and the other acts in parallel therewith.

7. A centrifugal regulator system according to claim 1, including a guide member, a guide lever and wherein said governor member comprises a sleeve, said sleeve being pivotal relative to said guide member and further including an extremity that is pivotally attached to said guide lever, said guide lever having a free end portion affixed to said force transfer member.

8. A centrifugal regulator system according to claim 7, in which said intermediate lever and said guide lever are pivotally secured in proximity to the fulcrum of said swing lever.

9. A centrifugal regulator system according to claim 1, including shutdown means for opposing said further spring means which tends to maintain said swing lever in contact with said intermediate lever.

* * * * *